US006530336B2

(12) United States Patent
Ibata et al.

(10) Patent No.: US 6,530,336 B2
(45) Date of Patent: Mar. 11, 2003

(54) BOX ARRANGEMENT FOR WATERCRAFT

(75) Inventors: Toshiaki Ibata, Shizuoka (JP); Kenichi Ootsuka, Shizuoka (JP); Akira Nakatsuji, Shizuoka (JP); Toshiyuki Hattori, Shizuoka (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/005,750

(22) Filed: Nov. 7, 2001

(65) Prior Publication Data

US 2002/0053308 A1 May 9, 2002

(30) Foreign Application Priority Data

Nov. 7, 2000 (JP) ..... 2000-338819

(51) Int. Cl.[7] ..... B63B 35/73
(52) U.S. Cl. ..... 114/55.5
(58) Field of Search ..... 114/55.5, 361, 114/363, 343, 364

(56) References Cited

U.S. PATENT DOCUMENTS

| | | | | |
|---|---|---|---|---|
| 4,909,176 | A | | 3/1990 | Kobayashi |
| 4,998,966 | A | | 3/1991 | Yamaguchi |
| 5,050,517 | A | | 9/1991 | Kobayashi |
| 5,094,516 | A | * | 3/1992 | Hunter ..... 312/319.1 |
| 5,438,946 | A | | 8/1995 | Kobayashi |
| 5,676,086 | A | | 10/1997 | Watkins |
| 5,857,423 | A | | 1/1999 | Imaeda et al. |
| 5,984,810 | A | | 11/1999 | Frye et al. |
| 6,089,174 | A | | 7/2000 | Slikkers et al. |
| 6,112,686 | A | | 9/2000 | Tsumiyama et al. |
| 6,192,823 | B1 | | 2/2001 | Tsumiyama et al. |
| 6,250,983 | B1 | | 6/2001 | Patersron |
| 6,276,290 | B1 | | 8/2001 | Yamada et al. |

FOREIGN PATENT DOCUMENTS

| | | |
|---|---|---|
| JP | 6-227484 | 8/1994 |
| JP | 6-270883 | 9/1994 |
| JP | 6-305479 | 11/1994 |
| JP | 6-312684 | 11/1994 |
| JP | 7-45428 | 2/1995 |
| JP | 8-207887 | 8/1996 |
| JP | 10-7080 | 1/1998 |

* cited by examiner

*Primary Examiner*—Stephen Avila
(74) *Attorney, Agent, or Firm*—Knobbe, Martens, Olson & Bear, LLP

(57) ABSTRACT

A watercraft has a mid-deck storage compartment. The storage compartment is mounted between a forward portion of the seat and a control mast. The storage compartment inclines rearward and partially overhangs an access opening into an engine compartment that is disposed beneath the seat. A box that is detachably connected to a deck of the watercraft defines the compartment. A cup holder can be disposed within the compartment with storage areas being defined around the cup holder and any cup or can that might be secured by the cup holder. The compartment also expands laterally as it increases in depth.

23 Claims, 9 Drawing Sheets

BOX ARRANGEMENT FOR WATERCRAFT

This application is base on and claims priority to Japanese Patent Application No. 2000-338819, filed Nov. 7, 2000, the entire contents of which is hereby expressly incorporated by reference.

BACKGROUND OF THE INVENTION

1. Field of the Invention

The present invention generally relates to hull constructions for watercraft. More particularly, the present invention relates to storage compartments that are disposed on the hulls of personal watercraft.

2. Description of the Related Art

Personal watercraft are a sporting type of watercraft. The watercraft, however, are fairly compact in construction with very little available space for storage of personal items. Accordingly, excursions on such watercraft tend to be fairly short trips that often return directly to the point of origin. Additionally, most watercraft are provided with awkwardly accessed bow storage bins. These bins, however, are inconvenient for items that may be consulted or used frequently during an outing.

Furthermore, an engine that powers such watercraft commonly is mounted beneath an operator seat. Access to the engine typically is obtained by removing the seat to expose an access opening. Because much servicing of the engine occurs through this access opening, the access opening desirably is as large as possible. Such a construction, however, further restricts the amount of available space in which storage compartments can be disposed.

SUMMARY OF THE INVENTION

Accordingly, a watercraft is desired in which an accessible storage compartment is disposed within easy arm reach of an operator. The compartment preferably should be positioned for access by an operator seated in an operating position. The compartment also preferably should admit to rapid, frequent and easy access. Furthermore, the compartment desirably should make advantageous use of available space while being removable to further expand the available opening into the internal cavities of the watercraft for routine maintenance and servicing.

One aspect of the present invention involves a personal watercraft comprising a deck with the deck comprising a pedestal. A seat is supported by the pedestal and a cavity is defined at least partially within the pedestal. An access opening is defined by a portion of the pedestal and the seat is disposed generally over the access opening. A control mast extends upward through the deck and the control mast is disposed forward of the seat. A storage bin is disposed between the control mast and the seat with the storage bin being at least partially disposed within a vertical volume defined by an outer periphery of the access opening. The storage bin is intersected by a longitudinally extending vertical reference plane.

Another aspect of the present invention involves a watercraft comprising a deck and a lower hull. A longitudinal vertical plane generally bisects the watercraft into two substantially equal portions. A cavity is defined between the deck and the hull. A first storage bin is positioned along the deck such that the plane intersects the first storage bin. A second storage bin is positioned along the deck such that the plane intersects the second storage bin. A third storage bin is positioned along the deck such that the plane intersects the third storage bin. The second storage bin is disposed between the first storage bin and the third storage bin. A seat is mounted generally rearward of the second storage bin and the second storage bin is accessible by an operator seated on the seat.

BRIEF DESCRIPTION OF THE DRAWINGS

These and other features, aspects and advantages of the present invention will now be described with reference to the drawings of a preferred embodiment, which embodiment is intended to illustrate and not to limit the invention. The drawings comprise 12 figures.

DETAILED DESCRIPTION OF THE PREFERRED EMBODIMENT

The present invention generally relates to hull constructions for personal watercraft and, more particularly, improved storage configurations. The storage configurations are described in conjunction with personal watercraft because this is an area of application for which the storage configurations have particular utility. Those of ordinary skill in the relevant arts will readily appreciate that the arrangements described herein also may have utility in a wide variety of other settings. For instance, the storage configurations also can be used in other types of marine craft and land vehicles, such as snowmobiles, all terrain vehicles and the like, where desirable. Thus, unless otherwise specified, the scope of the present invention is not intended to be limited to personal watercraft.

Figure 1:
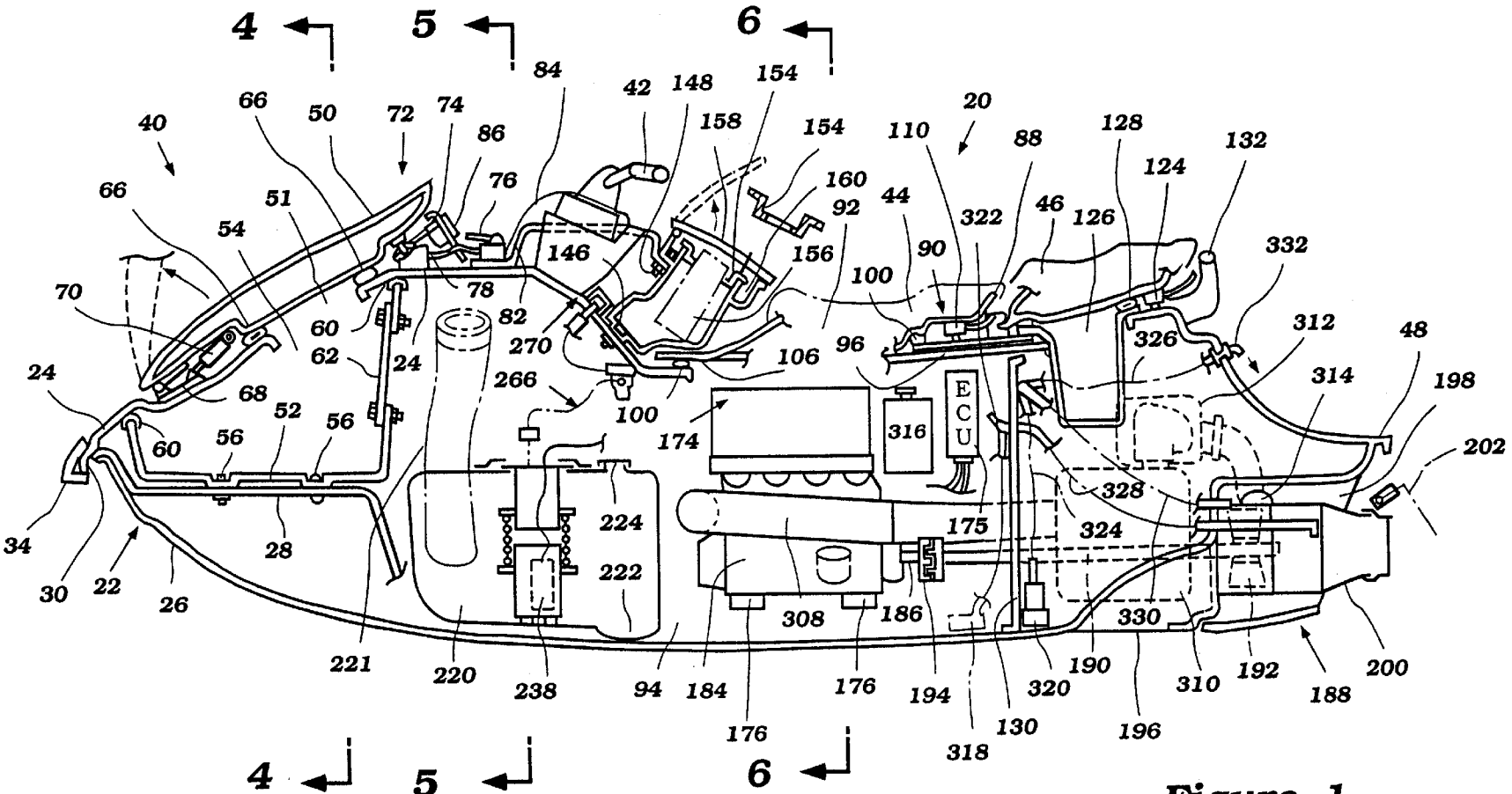
FIG. 1 is a partially-sectioned, side elevation view of a personal watercraft arranged and configured in accordance with certain features, aspects and advantages of the present invention. Certain components have been illustrated with hidden lines and other components are not illustrated for clarity.

With reference initially to FIG. 1, a personal watercraft, which is indicated generally by the reference numeral 20, is illustrated therein. As indicated near the tip of the bow of the watercraft 20, the illustrated watercraft 20 includes a hull 22 that is defined by a upper portion or deck 24 and a lower portion 26. In the illustrated arrangement, a liner 28 is disposed between the upper portion 24 and the lower portion 26.

These portions 24, 26 28 of the hull 22 preferably are formed from a suitable material such as, for example, a molded fiberglass reinforced resin. For instance, the deck 24 can be formed using a sheet molding compound (SMC), i.e., a mixed mass of reinforced fiber and thermal setting resin, that is processed in a pressurized, closed mold. The molding process desirably is temperature controlled such that the mold is heated and cooled during the molding process. For this purpose, male and female portions of the mold can include fluid jackets through which steam and cooling water can be run to heat and cool the mold during the manufacturing process.

Figure 9:
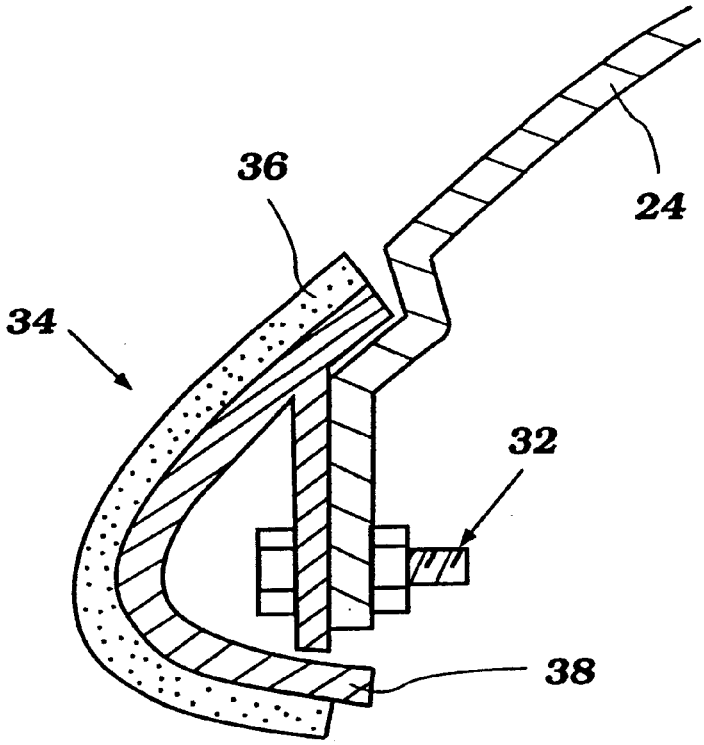
FIG. 9 is a sectional view of a portion of the hull illustrating an improved bumper construction used on the watercraft of FIG. 1.

The lower hull portion 26 and the deck 24 preferably are joined around a peripheral edge at a bond flange 30. Thus, the bond flange 30 generally defines the intersection of the lower portion 26 of the hull 22 and the deck 24. With reference to FIG. 9, the deck 24 preferably slightly overhangs the bond flange 30. In the illustrated configuration, a nut and bolt combination 32 secures a bow bumper 34 to the overhanging portion of the deck 24.

Figure 2:
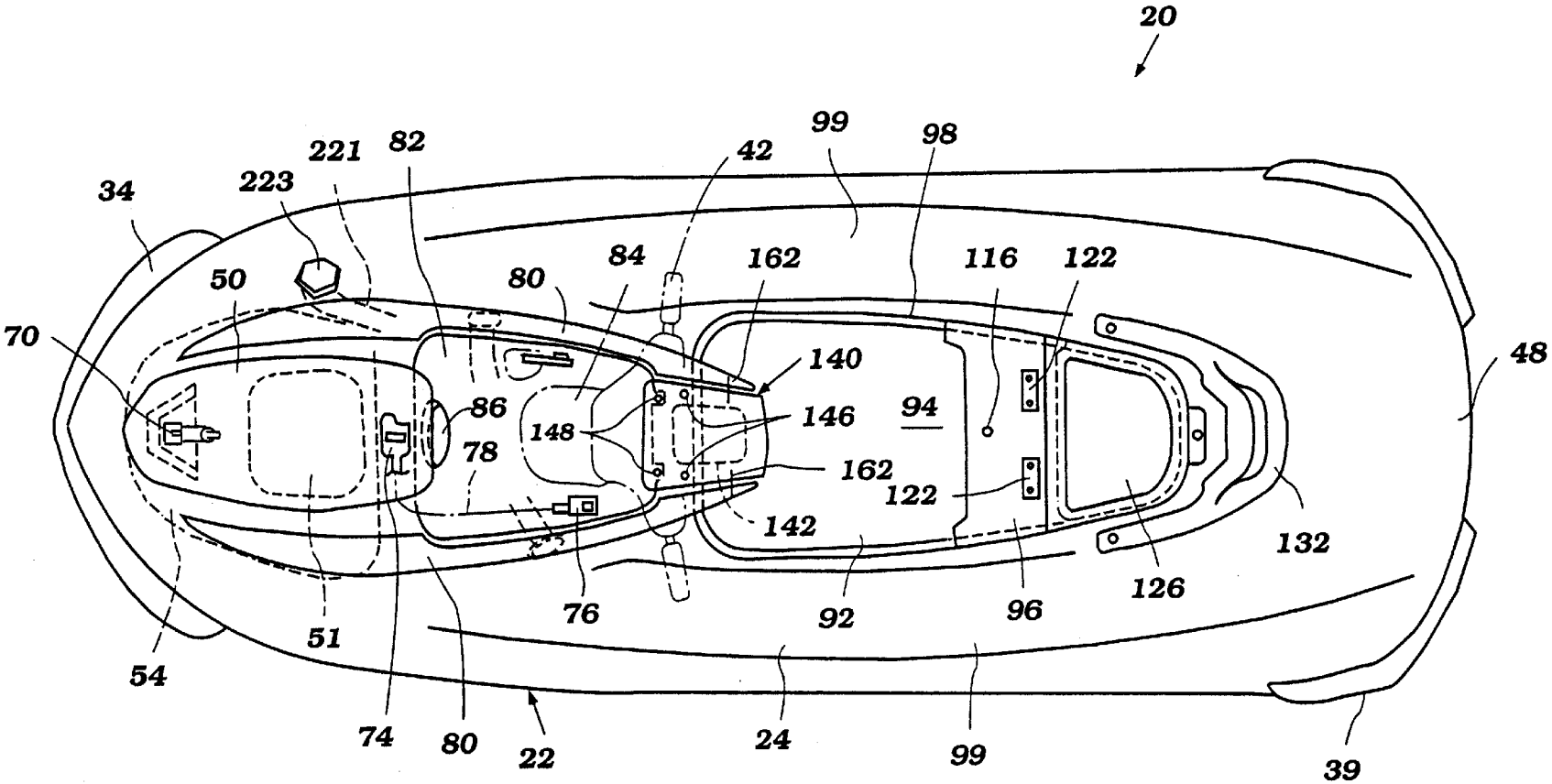
FIG. 2 is a top plan view of the watercraft of FIG. 1. Certain components are illustrated with hidden lines, other components are illustrated with phantom lines and yet other components are not illustrated for clarity.

The illustrated bow bumper 34 preferably comprises a two-part construction that is designed to absorb slight impacts, such as those encountered when docking. In one arrangement, the two parts are formed of a polypropylene and rubber composite with differing mixing ratios. For instance, the outer layer 36 can be stronger and resistant to scuffing, rubbing and other acts that might mar the surface or otherwise detract from an aesthetic appearance while the inner layer 38 can be softer to better absorb shock loads. With reference to FIG. 2, stern bumpers 39 also can be provided for the watercraft 20. The stern bumpers 39 can be constructed similarly to the bow bumper 34.

With reference again to FIG. 1, the deck 24 includes a bow portion 40. Rearward of the bow portion 40 is a control mast 42 that is disposed forward of both a front seat 44, a rear seat 46 and a boarding platform 48. The bow portion 40 preferably slopes upwardly toward the control mast 42. The control mast 42 supports a handlebar assembly that controls the steering of the watercraft 20 in a conventional manner. The handlebar assembly also carries a variety of the controls of the watercraft, such as, for example, a throttle control, a start switch and a lanyard switch. The handlebar assembly desirably is mounted for pivotal movement forward of the front seat 44.

A hatch cover 50 can be provided in the bow portion 40. The hatch cover 50 preferably is pivotably attached to the deck 24 and preferably is capable of being selectively locked in a closed and substantially watertight position. The hatch cover 50 preferably covers an opening 51 to a bow storage bin 52. The bow storage bin 52 generally defines a bow storage space 54 in which a rider or operator of the watercraft can place articles for transportation, for instance.

The bow storage bin 52 preferably is mounted within an opening defined between the deck 24 and the liner 28. In the illustrated arrangement, the bow storage bin 52 is secured in position relative to the liner 28 with fasteners 56 that are positioned within recesses formed in the bottom of the bow storage bin 52. The recesses advantageously position an upper portion of the fasteners 56 flush with or lower than a lower internal surface of the bow storage bin. Thus, the fasteners 56 are less likely to snag any articles placed into the bow storage bin 52.

Figure 4:
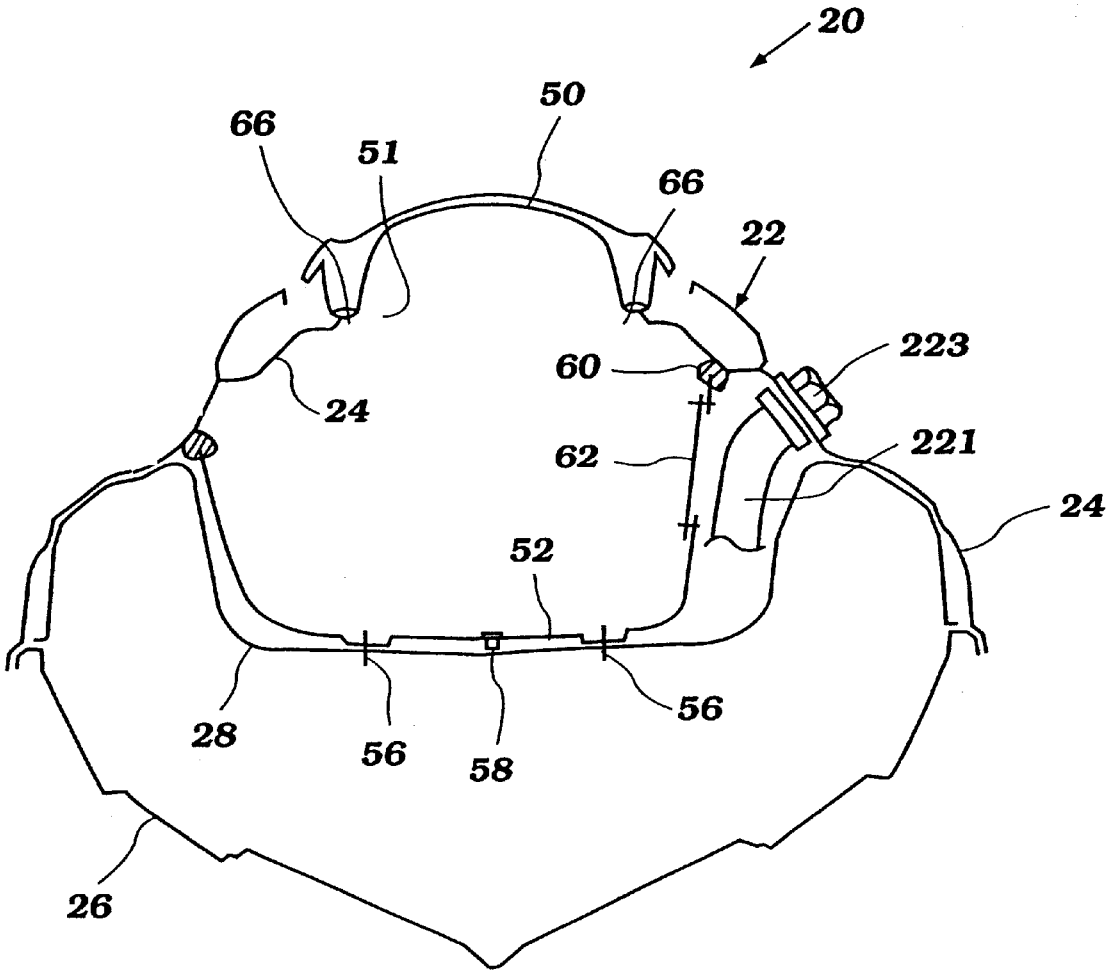
FIG. 4 is a simplified sectional view of the watercraft of FIG. 1 taken along the line 4—4 in FIG. 1.

With reference to FIG. 4, the bow storage bin 52 also preferably comprises a drain 58. The drain 58 in the illustrated arrangement extends through the bottom of the bow storage bin in a central location. Advantageously, this location places the outlet of the drain 58 between the recesses through which the fasteners 56 extend. Thus, in the illustrated arrangement, water or other liquid passing through the drain 58 can travel over a portion of the illustrated liner, which slopes downward in a rearward direction, toward a desired collection location for removal from the watercraft. Other suitable locations of a drain also can be used.

With continued reference to FIG. 4, the bottom wall of the illustrated bow storage bin 52 is integrally formed with upwardly extending sidewalls. In some constructions, the sidewalls may not be integral with the bottom wall and the drain can be formed by providing openings at one or more of these intersections. Additionally, the shape of the bow storage bin 52 and the number of sidewalls can be varied as desired. At an upper end of the sidewall or sidewalls, a seal 60 is provided. The seal 60 advantageously is interposed between the side wall of the bow storage bin 52 and an inner surface of the deck 24 or other adjacent surface. The seal reduces the likelihood of ingress of water through the joint between the bow storage bin 52 and the body of the watercraft 20.

One or more removable panels 62 preferably form a portion of the bow storage bin 52. These removable panels 62 can be secured in place in any suitable manner. For instance, in some applications, the panels 62 may be hinged along one side to the bow storage bin 52. In other applications, the panels 62 may slide within a slide track created by suitable members, such as opposing L-shaped brackets. In yet other applications, the panels 62 may be secured in position using pins, threaded fasteners, clips or other similar mechanical members. In the illustrated arrangement, the panels 62 are secured in position by threaded fasteners 64 that extend through each of the comers of each of the panels 62. Once removed, components positioned within the body of the watercraft but outside of the bow storage bin can be accessed through the opening over which the panel 62 is ordinarily disposed.

With continued reference to both FIGS. 1 and 4, the illustrated watercraft also features a seal 66 that is disposed about the circumference of the opening 51 leading into the bow storage bin 52. The seal 66 preferably is disposed along an outer surface of the deck 24. In some constructions, such as those in which the opening 51 is not defined through a portion of the deck 24, the seal 66 can be disposed on a cover or other body panel. Also, the seal 66 can be mounted to the underside of the hatch cover 50. A lower surface of the hatch cover 50 preferably abuts the seal 66 such that the seal 66 is effectively sandwiched between the hatch cover 50 and the deck 24, such as the arrangement illustrated in FIG. 4.

Forward of the seal 66, the illustrated hatch cover 50 is pivotally connected to the deck 24 such that the hatch cover 50 can pivot about a forward end. Preferably, a hinge member 68 forms the pivotal connection. Other suitable pivotal connections also can be constructed. In some constructions, the hatch cover 50 may be connected to the deck 24 such that it will pivot about a lateral side; however, pivoting about a forward end eases access into the bow storage bin 52.

To further aid access into the bow storage bin 52, a gas spring cylinder 70 or other suitable lifting member can be provided. The gas spring cylinder 70 can be provided to provide enough lifting force to raise an unlatched hatch cover on its own. In other arrangements, the gas spring cylinder 70 can be sized to merely maintain the position of the hatch cover once manually raised. Preferably, the lifting member 70 is disposed between the hinge 68 and the seal 66. More preferably, both the hinge 68 and the lifting member 70 are substantially concealed from external view beneath the hatch cover 50.

A locking mechanism 72 is disposed at an upper end of the illustrated hatch cover 50. In a presently preferred construction, the locking mechanism 72 comprises a locking member 74 that is connected to an actuator 76 by a cable or other suitable transmission component 78. The actuator 76 preferably is positioned rearward of the locking member 74. Preferably, the locking member 74 is disposed along a longitudinally extending generally vertical plane. In one arrangement, the actuator is positioned laterally to one side of and rearward of the locking member 74.

The locking member 74 can comprise a biased finger that hooks under a U-shaped strike when not being actuated. In such a locking mechanism, the actuator 76 can comprise a lever that is connected to the locking member with a Bowden wire cable such that, when the lever is depressed or lifted, the finger releases the strike and the hatch cover 50 can be raised. Other constructions of the particular components also can be used. For instance, an electrical construction can be used such that operation of the actuator sends an electric signal to the locking member to unlock the hatch cover 50. Such a construction would preferably be weatherproofed to mitigate the effect of the watery environment of use. In one particular construction, the electrical lines could extend though an inner cavity defined by the body of the watercraft and the lock member 74 could be disposed within the circumference defined by the seal 66. Other suitable constructions and arrangements of the locking member and the actuator also can be used.

In the illustrated arrangement, the locking member 74 is disposed very proximate the seal 66 (i.e., within about 2 to 9 inches). In some applications, the locking member 74 is disposed as close as mechanically possible to the seal 66. It has been discovered that placement of the locking member proximate the seal 66 increases the security of the sealing effect established by the seal 66 between the hatch cover 50 and the deck 24. Additionally, the locking member 74 preferably is substantially concealed from external view beneath the hatch cover 50. Such a construction noticeably improves the aesthetics of the watercraft and generally protects the locking member 74 from a large amount of water contact.

With reference now to FIG. 2, a side body panel 80 extends along each side of the bow of the watercraft. In particular, in the illustrated arrangement, the side body panels extend rearward from proximate a forward end of the bow hatch cover 50 and extend rearward to a position proximate a forward end of the front seat 44.

Rearward of the hatch cover 50 and between the side body panels 80, a center cover 82 extends rearward toward the control mast 42. In the illustrated arrangement, a forward end of the center cover 82 is disposed rearward of the locking member 74. The center cover 82 preferably includes a raised central portion 84 that encases a forward portion of the control mast 42 and other related components. In some constructions, this raise central portion 84 can form a separate component relative to the center cover 82. Preferably, at least a portion of the cable 78 extends beneath the center cover 82. As illustrated in FIG. 2, the center cover 82 and the bow hatch 50 advantageously shield a majority of the length of the cable 78.

A gauge cluster (i.e., multiple gauges or the like) or a single gauge 86 can be provided between the bow storage bin 52 and the control mast 42. In the illustrated arrangement, the gauge 86 is a speedometer that displays a reading of water speed of the watercraft 20. The gauge advantageously is nestled forward of the central portion 84 of the center cover 82, rearward of the bow storage bin 52 and below a rear lip of the hatch cover 50. In this position, the gauge 86 is blended into the fluid lines of the aesthetic design features of the watercraft 20. In addition, the gauge 86 is somewhat protected within this region. Furthermore, in the illustrated watercraft 20, the gauge 86 and the associated mounting brackets and housings provide addition protection to the locking member 74. In one construction, the gauge 86 can be mounted in a housing member that seals in any suitable manner with a portion of the deck 24 and the hatch cover 50 to define a subchamber in which the locking member 74 is enclosed for protection.

The front seat 44 and the rear seat 46 are desirably of the straddle-type. A straddle-type seat is well known as a longitudinally extending seat configured such that operators and passengers sit on the seat with a leg positioned to either side of the seat (e.g., two-wheeled motorcycles employ straddle seats). Thus, an operator and at least one passenger can sit in tandem on the seats 44, 46. Moreover, these seats 44, 46 are preferably centrally located between the sides of the hull 22.

The front seat 44 preferably is positioned on a bottom plate 88 that forms a portion of a seat supporting frame 90. The bottom plate 88 covers an access opening 92 that allows access into a cavity 94, which comprises at least an engine compartment, that is defined within the hull 22. Of course, the two seats 44, 46 can be combined in some arrangements into a single seat mounted to the watercraft by a single bottom plate or the like.

Figure 6:
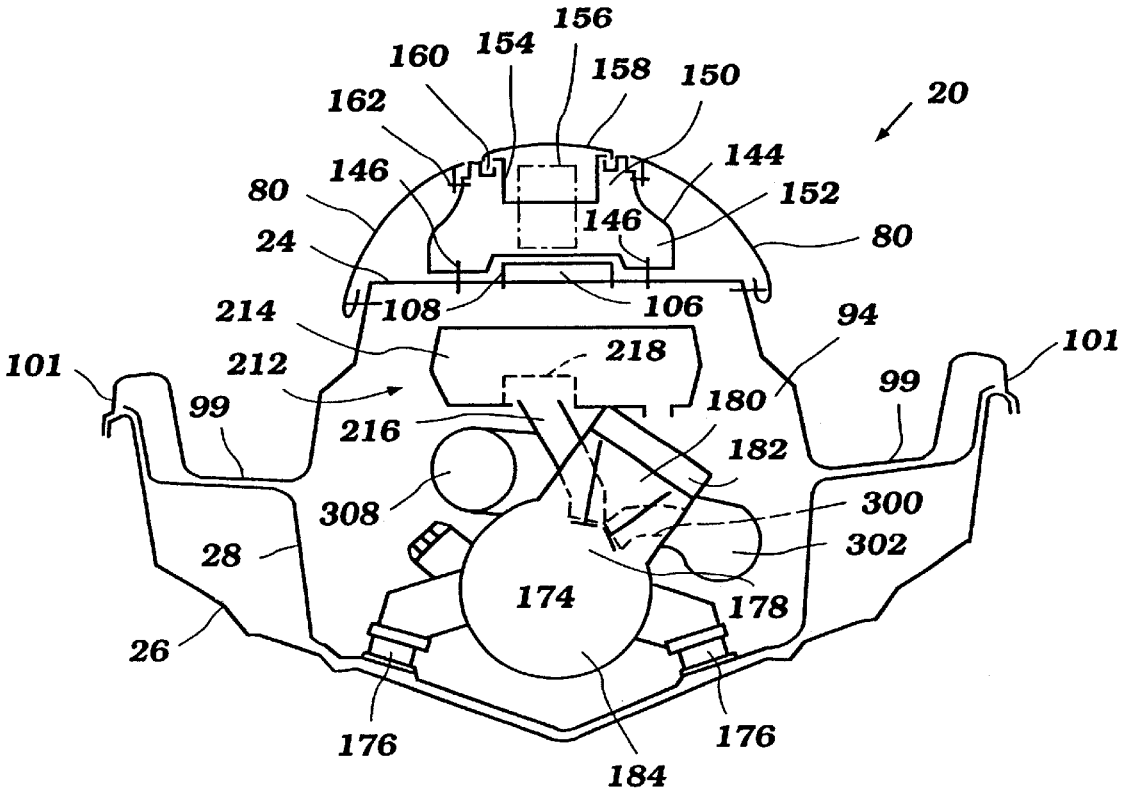
FIG. 6 is a simplified sectional view of the watercraft of FIG. 1 taken along the line 6—6 in FIG. 1.

With reference to FIG. 2, the illustrated bottom plate 88 for the front seat 44 is supported by a bridgeboard 96. The bridgeboard 96 is supported on lateral sides of a seat pedestal 98. Generally, the pedestal 98 supports the front seat 44 and the rear seat 46 in the illustrated arrangement. Foot areas 99 are formed alongside the pedestal 98 and are generally defined as the lower area located between the pedestal 98 and a pair of raised side gunwales or bulwarks 101 that extend along the outer sides of the watercraft 20. As best illustrated in FIGS. 2 and 6, the foot areas 99 preferably are sized and configured to accommodate the lower legs and feet of the riders who straddle the seats 44, 46. As described above, the illustrated watercraft 20 also includes the boarding platform 48 that is connected to the illustrated foot areas 99 and that is formed at the rear of the watercraft 20 behind the pedestal 98.

The access opening 92 generally is defined within the pedestal 98. A lower surface of the bottom plate 90 or an upper surface of the bridgeboard 96 preferably carries a seal 100 that at least partially circumscribes the access opening 92. Thus, the seal 100 is sandwiched between the bottom plate 90 and the bridgeboard 96 and the seal 100 preferably is configured to substantially preclude water intrusion into the cavity 94 through the access opening.

Figure 10:
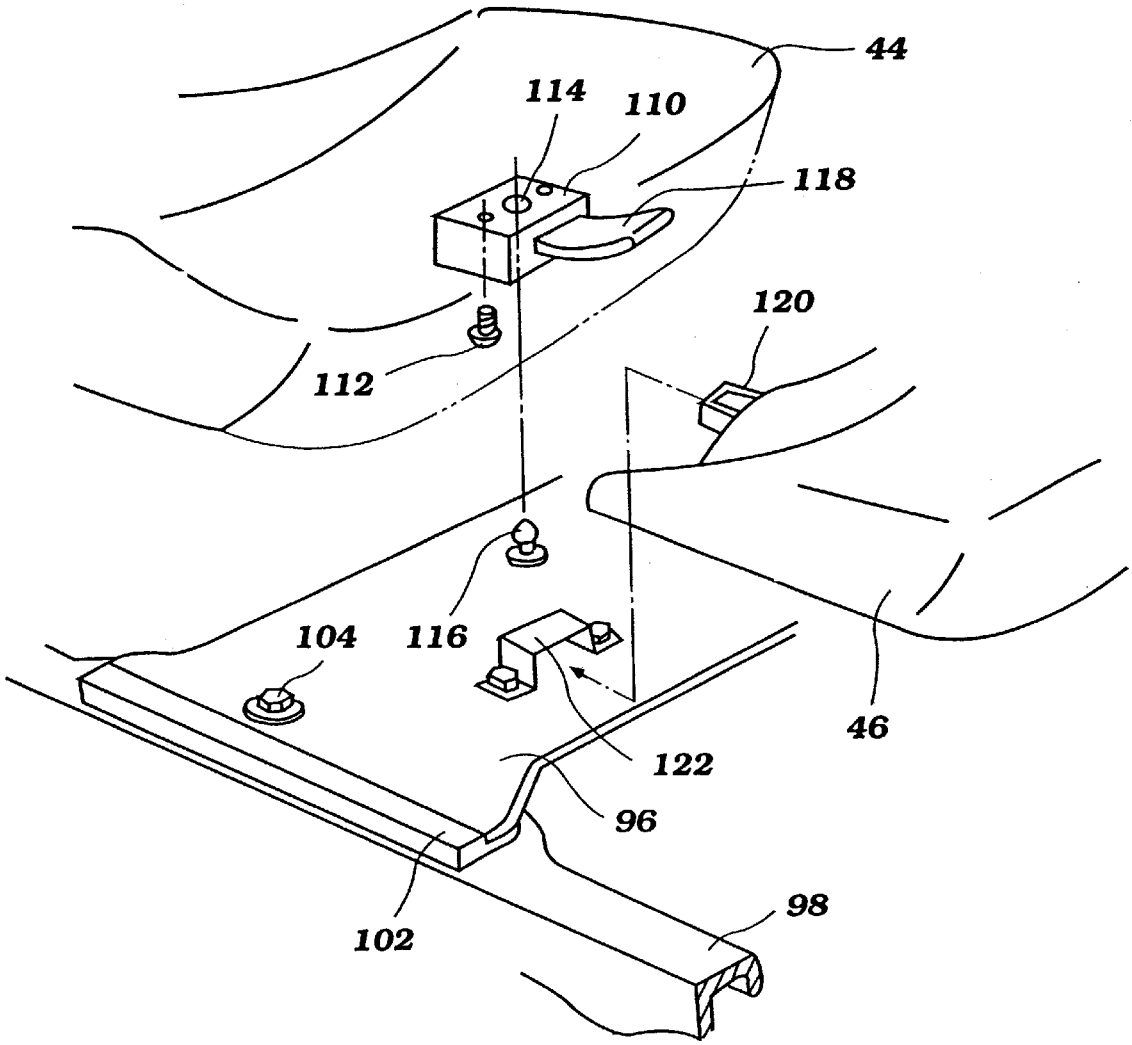
FIG. 10 is a perspective view of a seat mounting arrangement used on the watercraft of FIG. 1.
Figure 11:
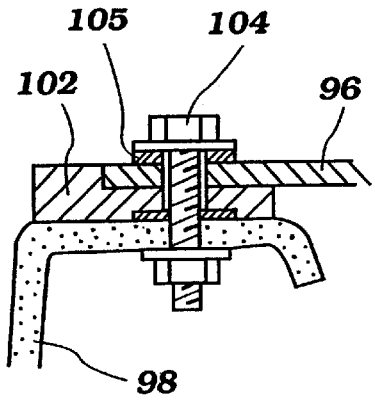
FIG. 11 is a sectional view of a portion of the seat mounting arrangement illustrated in FIG. 10.

With reference now to FIG. 10, the bridgeboard 96 preferably is mounted to the pedestal 98 with the use of resilient members 102 and suitable fasteners 104, such as bolts. As illustrated in FIG. 11, the fastener 104 and a washer 105 can be used to secure the bridgeboard 96 to the pedestal 98 with the resilient member 102 sandwiched in between the bridgeboard 96 and the pedestal 98. The illustrated resilient members 102 have a stepped configuration with the bridgeboard 96 resting upon a portion having a reduced thickness relative to the overall thickness of the resilient member 102. Preferably, the openings that received the fastener 104 are sized to reduce transverse contact between the resilient member, the bridgeboard and the fastener. Such a construction reduces the transfer of side-to-side vibrational energy. The resilient members 102 can be formed of any suitable vibration-absorbing or vibration-damping material, including rubber, for instance. Advantageously, the resilient members 102 reduce vibrational energy that can be transferred from the pedestal 98 to the bridgeboard 96 and, ultimately, to individuals seated on the seats 44, 46.

With reference to FIG. 1, the front seat 44 preferably is supported at a forward end with at least a tongue 106 that is supported within a channel 108, which will be discussed below in more detail. With reference now to FIG. 10, at a rear portion, the front seat 44 preferably includes a lock member 110. The lock member 110 can be secured to the front seat 44 with a pair of threaded fasteners 112. Other manners of securing the lock member 110 in position also can be used. The lock member 110 preferably includes a central aperture 114 that receives a knob 116 that extends upward from the bridgeboard 96. In some configurations, the knob 116 can be mounted to the seat and the lock member 110 can be secured to the bridgeboard 96. As illustrated, a lever 118 preferably extends rearward from the lock member 110 and allows an operator to release the knob 116 from the lock member 110. Thus, the lever 118 is disposed for fairly easy access to release the knob 116 from within the aperture 114 such that the front seat 44 can be removed from the bridgeboard 96 and, ultimately, the watercraft 20.

With continued reference to FIG. 10, a forward portion of the rear seat 46 preferably comprises a pair of engaging tabs 120 that are received within suitably configured receptacles 122 (see FIG. 2). The receptacle 122 in the illustrated arrangement is a generally U-shaped plate that is secured to the bridgeboard 96 with threaded fasteners. Other configurations can be used. With the tab 120 engaged within the receptacle 122, the rear seat 46 can be secured in position on the watercraft 20 using a further lock member 124, which can be similarly constructed to the lock member 110 associated with the front seat 44. Preferably, a rear storage bin 126 is disposed beneath the rear seat 46 and a seal 128 circumscribes an upper opening of the rear storage bin 126. The rear storage bin 126, in the illustrated arrangement, extends downward into a rearmost compartment that is defined within the hull 22 by an aft bulkhead 130, at least in part.

Figure 7:
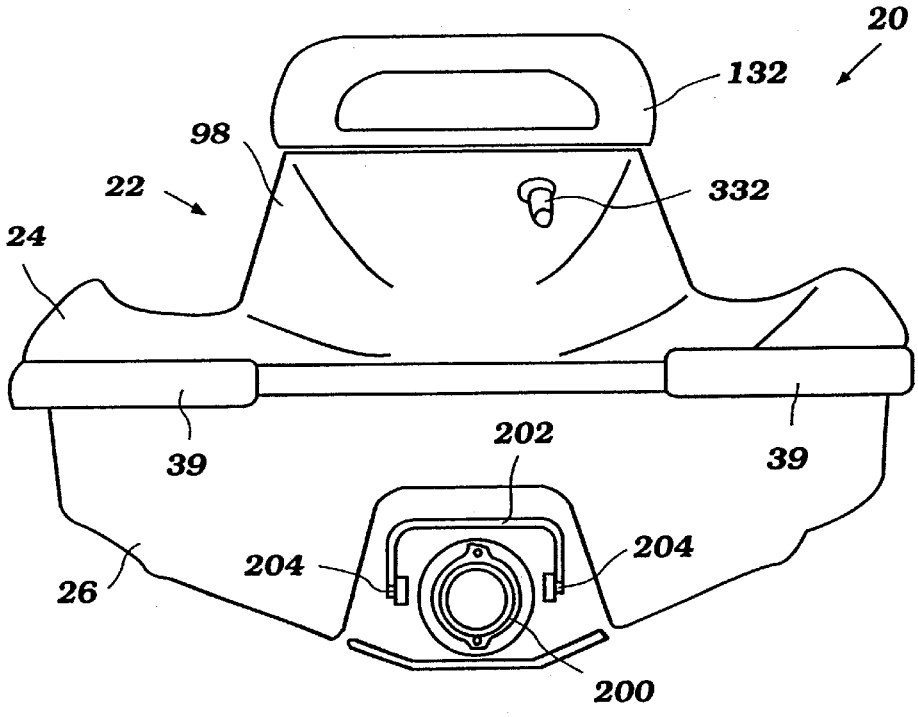
FIG. 7 is a rear elevational view of the watercraft of FIG. 1.
Figure 8:
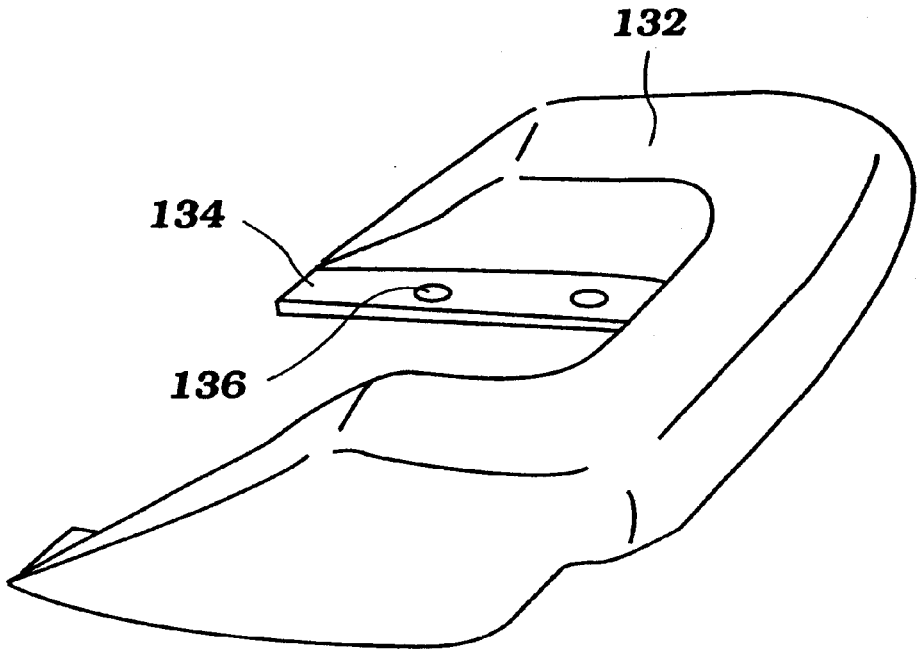
FIG. 8 is a perspective view of a portion of a handle used on the watercraft of FIG. 1.

With reference now to FIGS. 2, 7 and 8, a handle 132 can be provided at an aft end of the pedestal 98. The handle 132 advantageously provides a handhold for riders of the watercraft 20 to pull themselves up to the boarding platform 48. As illustrated in FIG. 8, the handle 132 preferably comprises an integrally formed flange 134 that includes a number of holes 136 through which fasteners can extend to fasten the flange 134 and the associated handle 132 to a suitable portion of the deck 24, such as the pedestal 98.

The illustrated watercraft 20 advantageously comprises a mid-deck storage compartment 140. Thus, the illustrated watercraft comprises three storage compartments that are positioned along, and spaced from one another along, a vertical longitudinal center plane. With reference to FIG. 2, the mid-deck storage compartment 140 comprises an opening 142 that overlaps in a vertical plan view with the access opening 92 such that a rear portion of the opening 142 is positioned within an imaginary vertical volume defined in a vertical direction by the access opening 92. This construction takes advantage of available space within in vehicle such that a compact construction can be achieved without unnecessarily inhibiting access into the cavity 94 that is accessed through the access opening 92.

With reference now to FIG. 1, the illustrated mid-deck storage compartment 140 comprises a removable storage bin 144. In one preferred construction, the bin 144 is disposed within an opening formed between the center cover 82 and a forward portion of the front seat 44. In some configurations, the storage bin 144 can be removed and the opening covered by an auxiliary body panel (not shown). The illustrated storage bin 144 advantageously comprises a first section that is substantially rectangular and a second section that doglegs forward from a lower portion of the first section. This construction makes advantageous use of space available upon the illustrated watercraft 20. Other constructions are possible and other shapes and configurations can be used as desired.

As indicated above, the storage bin 144 preferably is removable. In some applications, the storage bin may be made permanent within the watercraft. In the illustrated arrangement, the storage bin 144 is secured to the watercraft with two sets of fasteners 146. While other suitable connection techniques (tongue and groove, threaded fasteners, snap-fit, sliding fit, etc.) can be used, the illustrated storage bin 144 is secured in position using a first set of threaded fasteners 146 to the deck and a second set of threaded fasteners 148 to the center cover 82. These two sets of threaded fasteners 146, 148 preferably extend in generally the same axial direction to ease access to the threaded fasteners 146, 148 and these two sets of threaded fasteners 146, 148 preferably are separated into two different horizontal planes. Furthermore, in one preferred construction both sets of threaded fasteners 146, 148 are disposed on a forward half of the storage bin 144. The different planes and forward position of the fasteners better distributes the load on the fasteners that is created by items stored within the sloping storage bin 142.

With reference to FIG. 6, the illustrated storage bin 144 has a downwardly expanding construction such that an upper portion 150 has a smaller volume than a lower portion 152. By expanding the volume in a downward direction, the storage bin 144 can complement the shape of the watercraft 20 in the mid-deck portion. Additionally, the overall volume of the storage bin 144 can be increased.

As illustrated in FIGS. 1 and 6, a removable beverage holder 154 (indicated in FIG. 1 in two locations—showing the easy removability of the beverage holder 154) can be inserted into the storage bin 144. Preferably, the beverage holder includes an upset flange that is received over the throat of the storage bin 144. Other constructions also can be used. For instance, while not illustrated, the beverage holder 154 can include pins or can be mounted on pins (or other suitable construction) such that any cup or can 156 supported by the beverage holder 154 will pivot under the force of gravity to maintain the cup or can 156 in a substantially upright position.

In one arrangement, the beverage holder 154 tightly receives the cup or can 156 such that the beverage holder is removed from the storage bin 144 with the cup or can 156.

In another arrangement, the beverage holder 154 loosely retains the cup or can 156 and the bottom of the bin 144 supports the bottom of the cup or can 156 to limit downward movement of the cup or can 156 into the bin 144. In a preferred construction, the bin is sized and configured such that a standard beverage can disposed within the beverage holder 154 will rest on a portion of the bottom of the bin 144 and a lid 158 can close over the can 156.

The lid 158 preferably is pivotally attached to the storage bin 144 such that the lid 158 pivots about a forward portion of the storage bin 144. In one arrangement, the lid 158 comprises a structure on its lower surface that can accept the upper end of the can or cup 156 to reduce splashing that may be caused by rough waters and an open top cup. In effect, the lid 158 can form a lid for the container (cup or can).

The storage bin 144 can include a drain, if desired. Additionally, the storage bin can be sized and configured for more than one beverage holder 154, if desired. The lid can be biased to a closed position in any suitable manner (e.g., torsion springs). In some applications, the lid will remain in any location in which it is left; however, biasing the lid to a closed position is desired to limit the inflow of water and water spray during operation of the watercraft.

With reference to FIG. 1, an upstanding channel 160 is defined around the circumference of the opening into the storage bin 144. The channel 160 may drain to the outside of the storage bin 144 such that water or other liquids that may spill into the channel 160 is drained away from the storage bin 144. For instance, drain passages (not shown) may extend through a lower portion of the outer wall defining the channel 160. In one arrangement, the drain passages may be formed in the rearward portion of the laterally extending channel 160 that is positioned on the rearward side of the storage bin 144 because this portion is the lowermost portion on the inclined upper portion of the storage bin 144.

With reference to FIG. 6, the side body panels 80 can be secured to a portion of the storage bin 144 with any suitable fastening mechanism. In the illustrated arrangement, the rear portion of the side body panels 80 is secured to the storage bin 144 with generally horizontally extending threaded fasteners 162. A better integrated body construction results from connecting the side body panels 80 with the deck 24 in a fore region and the mid-deck storage bin 140 in a rear region of the panels 80.

With reference again to FIG. 1, the cavity 94 formed between the deck 24 and one or more bulkheads, such as the bulkhead 130, divide the lower portion 26 into an engine compartment 170 and a pump chamber 172. An in-line, four cylinder, four-cycle engine 174 preferably is mounted within the engine compartment 170 of the illustrated watercraft 20 using resilient mounts 176 as is well known to those of ordinary skill in the art. While the illustrated engine 174 is of the four-cycle variety, the engine 174 can also be of the two-cycle, rotary or diesel variety as well. Moreover, the engine 174 can have one, two, three or more than four cylinders and can be inclined, vertical, transverse, formed with two banks of cylinders that extend at an angle relative to each other (v) or formed with two opposing banks of cylinders.

Figure 3:
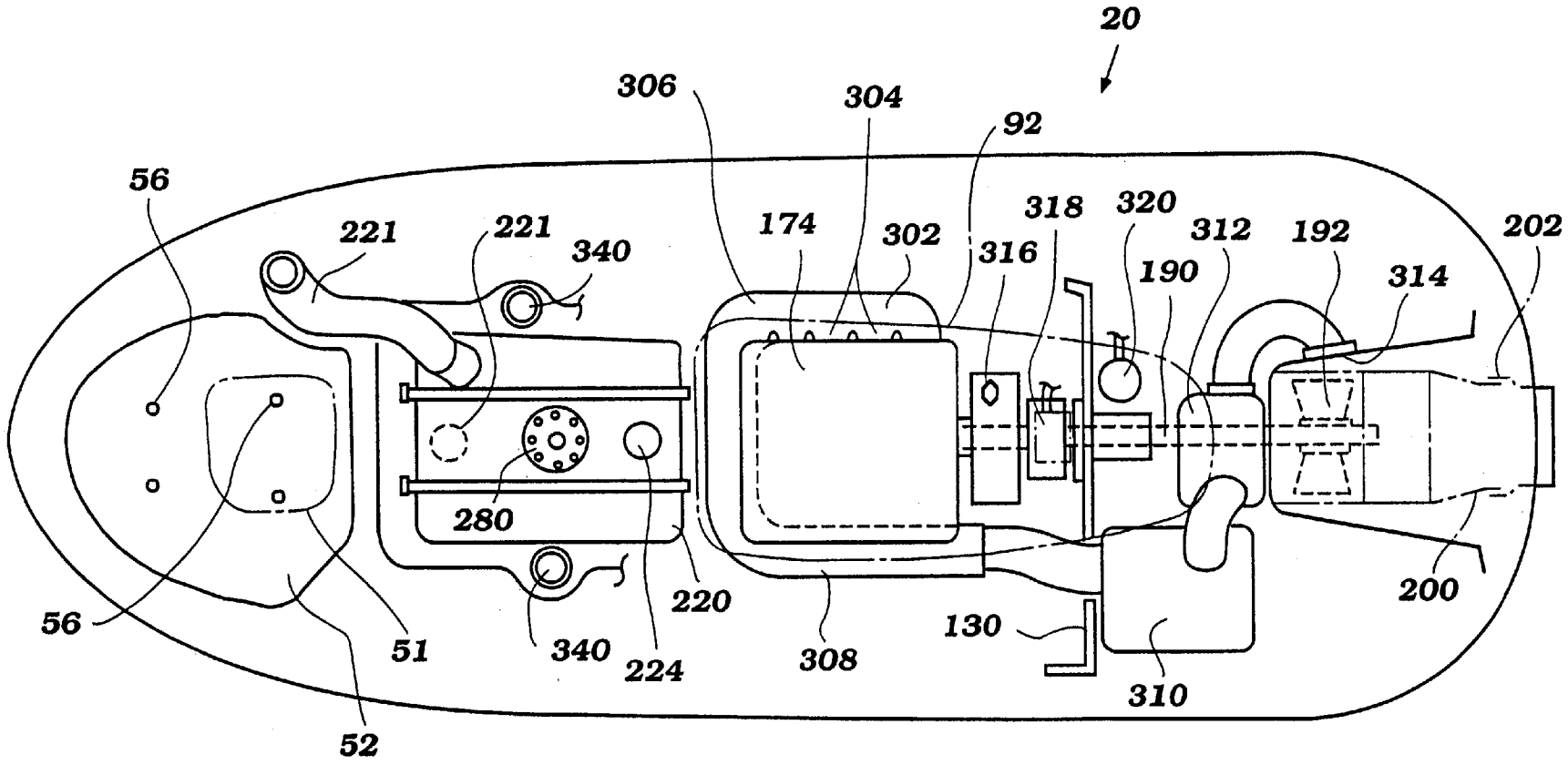
FIG. 3 is another plan view of the watercraft of FIG. 1 illustrating some of the internal components of the watercraft.

The general construction of the present four-cycle engine 174 is well known to those of ordinary skill in the art. Additionally, operations of the engine 174 can be controlled through the use of an ECU 175 in any suitable manner. As illustrated in FIGS. 1, 3 and 6, the engine 174 generally comprises a cylinder block 178, a cylinder head 180, a cylinder head cover 182 and a crankcase member 184. A set of cylinders (not shown) is formed within the cylinder block 178. The cylinder head 180 and the cylinder head cover 184 cap the cylinders. A piston (not shown) is reciprocally mounted within each of the cylinders. Each cylinder contains a combustion chamber defined by the top of the piston (not shown), the wall of the cylinder and a recess (not shown) formed within a lower surface (not shown) of the cylinder head 180.

The crankcase member 184 is attached to the opposite end of the cylinder block 178 from the cylinder head 180. A crankshaft 186 is positioned within the crankcase member 184 and is connected to the pistons (not shown) through a set of connecting rods (not shown). As the pistons (not shown) reciprocate within the cylinders, the crankshaft 186 is rotated within a crankcase chamber, which is at least partially defined by the crankcase member 184.

The crankshaft 186 preferably is in driving relation with a jet propulsion unit 188. Specifically, the jet propulsion unit 188 preferably includes an impeller shaft 190 to which a propeller or an impeller 192 is attached. The crankshaft 186 and the impeller shaft 190 desirably are connected through a conventional shock-absorbing coupling 194. The impeller shaft 190 extends in the longitudinal direction and extends through a propulsion duct that has a water inlet port 196 positioned on a lower surface of the hull 22. The lower portion 26 of the hull 22 also includes an opening 198 in the stern of the watercraft in which a nozzle 200 of the propulsion unit 188 is positioned. The propulsion unit 188 generates propulsive force by applying pressure to water drawn up from the water inlet port 196 by rotating the impeller shaft 190 and by forcing the pressurized water through the nozzle 200in a manner well known to those of ordinary skill in the art.

Figure 5:
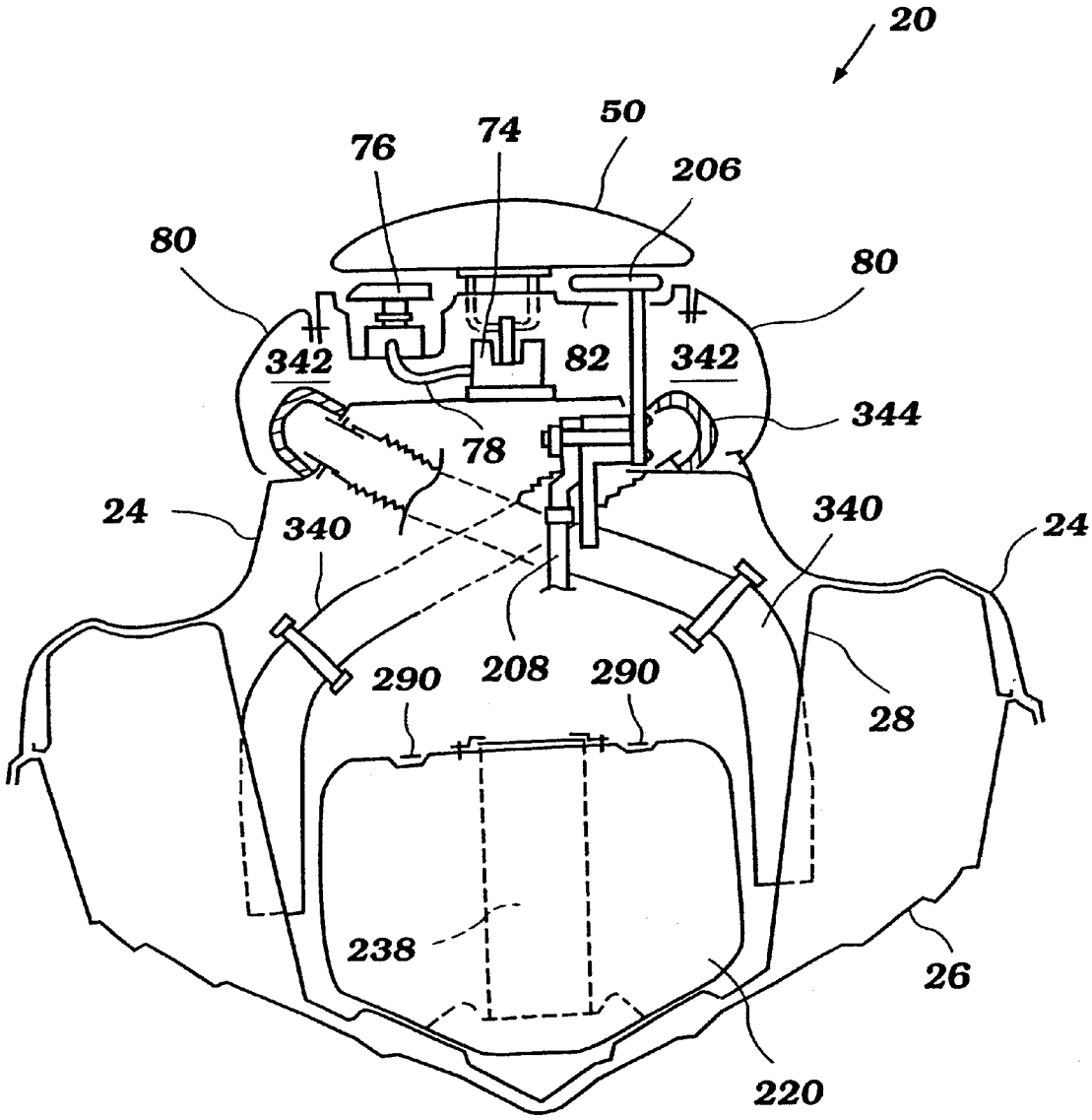
FIG. 5 is a simplified sectional view of the watercraft of FIG. 1 taken along the line 5—5 in FIG. 1.

A reverse bucket 202 is suitably mounted relative to the nozzle 200 with horizontally extending pins 204. Thus, the reverse bucket 202 can be pivoted in front of the nozzle 200 about an axis defined through the pins 204 such that a reversing thrust can be used to slow, stop and reverse the watercraft 20. An operator can control the movement of the reverse bucket 200 with a lever 206 that is connected to the reverse bucket 202 with a suitable linkage 208 (see FIG. 5). Other arrangements also can be used. A conventional steering arrangement also cooperates with the nozzle 200 to effect steering movement in accordance with operator demand.

With reference now to FIGS. 1, 6 and 7, the engine 174 also includes an induction system 212 that provides air to each combustion chamber (not shown) for combustion. Air within the engine compartment 170 is supplied to the engine 174 through the air intake system. A replenishable air supply is provided to the engine compartment 170 in manners that will be described in greater detail below.

Preferably, the air intake system includes an intake box 214 or silencer into which air from within the engine compartment 170 is drawn. The air is then pulled into an intake conduit 216 after passing through a water repellant filter 218. The air passes into the combustion chambers and can be mixed with fuel within the combustion chambers with direct fuel injection or can be mixed with fuel prior to passing into the combustion chambers (e.g., indirect injection, port injection or carburetion). Preferably, a throttle body (not shown) is provided to control the rate of air flow into the combustion chamber.

With reference now to FIGS. 1, 3, 5 and 11, fuel is drawn from a fuel tank 220 positioned within the cavity 94 defined by the hull 22. Fuel is provided to the fuel tank through a fuel fill tube 221 that extends upward from the fuel tank 220 to a location along an outer surface of the hull 22. Preferably, a cap 223 is provided to removably close the tube 221. Conventional means, such as straps or the like secure the fuel tank 220 in position along the lower hull portion 26 or liner 28.

With continued reference to FIG. 1, the fuel tank 220 advantageously comprises a water pool 222. Preferably, the water pool 222 is disposed in the lowermost portion of the fuel tank 220. Hence, a forward portion of the illustrated water pool 222 preferably slopes upward in a forward direction. In the illustrated arrangement, the water pool 222 is disposed in a rearmost portion of the fuel tank 220, as this comprises a lowermost portion of the illustrated fuel tank 220. In this manner, water, which is heavier than fuel, can sink into the water pool 222.

With reference now to FIG. 11, a water removal opening 224 is formed though an upper surface of the fuel tank 220. In particular, the unibody construction of the illustrated fuel tank 220, which comprises a single outer wall 226, also includes two openings, the water removal opening 224 and a fuel pump opening 228. Preferably, the water removal opening 224 is disposed directly above the water pool 222. Thus, the water removal opening 224 is advantageously designed to accept a water removal hose 230. The water removal hose 230 can be connected to a suitable pump, such as an electric pump 232.

In one configuration, the water removal hose 230 is inserted by a service technician during servicing and removed during normal operation. In such a configuration, the water removal opening 224 receives a removable lid 234. The lid preferably simply snaps into place and can be secured in position using a strap, band or other suitable mechanical fastening configuration 236. In some arrangements, the lid 234 can be threaded onto an outer surface that partially defines the water removal opening 224.

Figure 12:
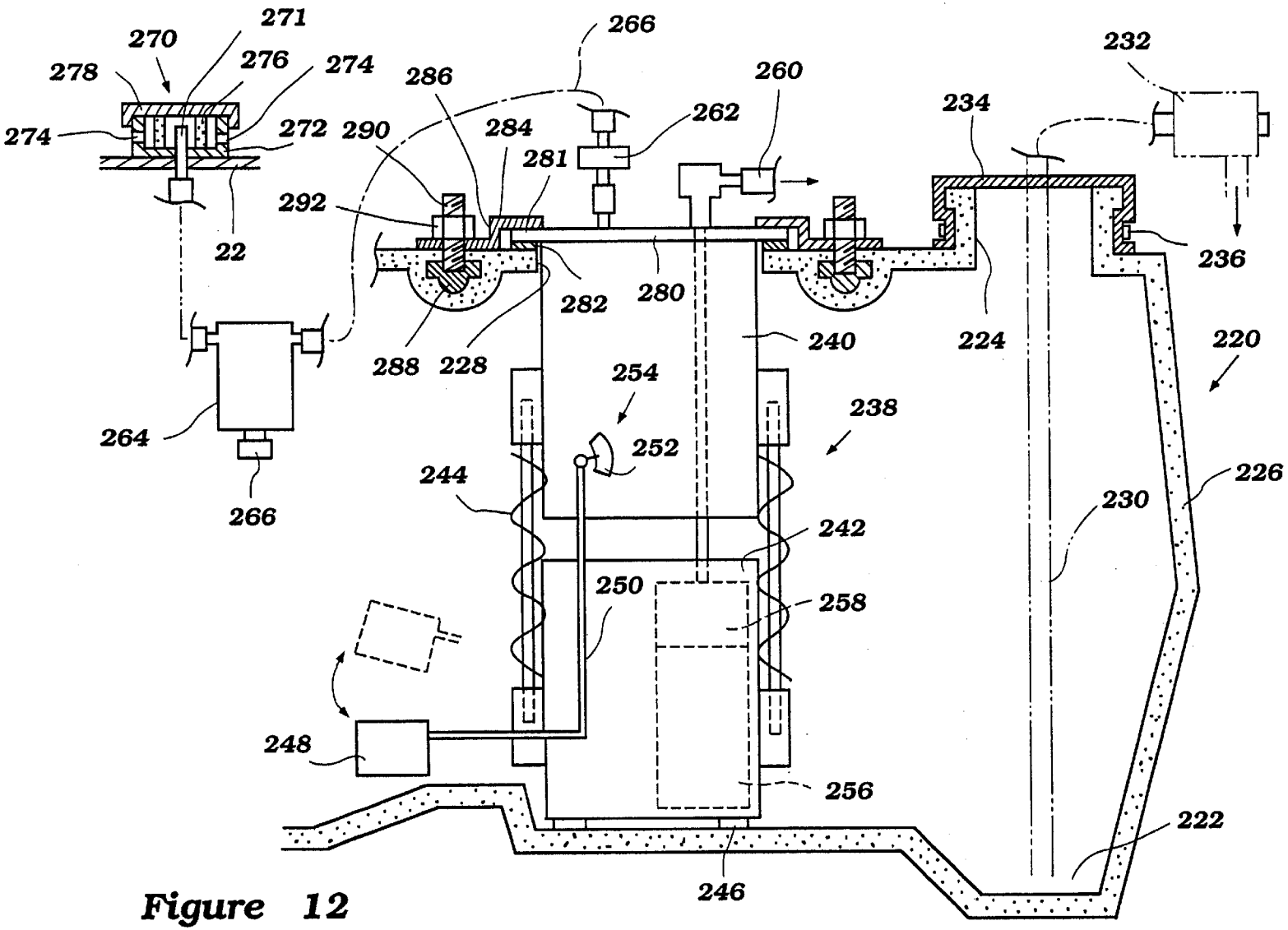
FIG. 12 is a sectional view of a portion of a fuel tank of the watercraft of FIG. 1. The sectional view illustrates a water pool, a selectively openable access into the fuel tank and a fuel supply unit mounting configuration, each of which has certain features, aspects and advantages in accordance with the present invention.

With continued reference to FIG. 12, fuel is supplied from the fuel tank 42 to a charge former (e.g., carburetor or fuel injector) through any suitable fuel pumping arrangement. In the illustrated arrangement, a fuel supply unit 238 is mounted to and in the fuel tank 220. The fuel supply unit 238 generally comprises an upper cylinder 240 and a lower cylinder 242. A spring 244 extends vertically adjacent the cylinders 240, 242. The lower cylinder 242 is spaced from the bottom surface of the fuel tank 220 with a set of spacers 246.

A float 248 is connected by a link 250 to a pointer that is disposed adjacent a scale 252. This assembly generally defines a level gauge 254 used to show the level of fuel within the fuel tank.

A fuel pump 256 and a vapor separator 258 are mounted within the fuel supply unit 238. In the illustrated arrangement, both of these components are mounted within the lower cylinder 242 of the fuel supply unit 238. Thus, fuel drawn from within the fuel tank 220 by the fuel pump 256 passes through the vapor separator 258 enroute to a fuel pipe 260. The fuel pipe 260 supplies fuel to the engine 174 for combustion.

Vapor gases separated from the fuel passes through a check valve 262, which reduces the likelihood that the vapor can return to the fuel tank 220. The check valve 262 is connected to a water removal unit 264 with an air pipe 266. The water removal unit 264 removes water that may become entrained in the vapor being removed through the air pipe 266. Preferably, the water removal unit 264 comprises a drain and a drain cap 268. The drain cap 268 can be removed to allow water contained within the water removal unit 264 to drain. Generally, the drain cap 268 is removed during servicing. The water removal unit 264 is disposed along the air pipe 266, in part, because a water-resistant ventilation unit 270 forms a housing for an outlet 271 of the air pipe 266.

The illustrated water-resistant ventilation unit 270 generally comprises a filter container 272 that is mounted to the hull 22. The container 272 preferably comprises a pair of openings 274 that are mounted on opposite walls of the container 272. Interposed between the outlet 271 of the air pipe 266 and the openings 274 are a pair of filters 276. The filters 276 preferably comprise a water repellant material and/or construction to reduce the likelihood of water entering into the fuel supply system through the vapor removal system. The illustrated container 272 advantageously is enclosed with a lid 278. Thus, vapor passing from the fuel tank 220 passes through the water removal unit 264 and one of a pair of water resistant filters 276 before escaping to the atmosphere. In some arrangements, a single water resistant filter 276 can be used. In other arrangements, more than two water resistant filters 276 can be used. As illustrated, the ventilation unit can be mounted proximate the mid-deck storage bin 140.

With reference again to FIG. 12, the fuel tank 220 also is constructed to reduce the likelihood that water can infiltrate the fuel storage area within the fuel tank 220. The fuel supply unit 238 comprises an outwardly extending upper flange 280 that has an outer portion 281 that creates dimension that is greater than a corresponding dimension of the opening 228 through which the fuel supply unit 238 is inserted into the fuel tank. Thus, the upper flange 280 provides a lip that can support the fuel supply unit 238 within the fuel tank.

A seal 282 can be positioned between the flange 280 and the fuel tank 220. Preferably, the seal 282 greatly reduces the likelihood that gas can leak out of the fuel tank 220 and that water or other contaminants can leak into the fuel tank 220.

A bracket or mounting ring 284 is used to secure the upper flange 280 in place on the fuel tank 220. In the illustrated arrangement, the mounting ring 284 has a stepped configuration with a downward jog 286 that is sized to compress the flange 280 and the seal 282 in position. Threaded inserts, acorn nuts, or insert nuts 288 are embedded within the wall defining the upper surface proximate the opening 228. While the nuts or inserts could be mounted in other regions, by embedding the nuts or inserts, the likelihood of leakage is greatly reduced. A stub shaft 290 extends into each insert or nut 288 and a nut 292 is used on each stub shaft 290 to tighten the mounting ring 284 in position. As discussed above, this mounting arrangement for the fuel supply unit 238 reduces the likelihood that fuel can leak through the opening 228 into the hull 22 and that water from within the hull 22 can leak into the fuel tank 220.

As discussed above, an air-fuel charge is passed to the combustion chamber for combustion. Thus, a suitable ignition system is provided for igniting the air and fuel mixture in each combustion chamber (not shown). Preferably, this system comprises a spark plug corresponding to each cylinder. The spark plugs preferably are fired by a suitable ignition system, as well known to those of skill in the art.

Exhaust gas generated by the engine 174 is routed from the engine 174 to a point external to the watercraft 20 by an exhaust system, which includes an exhaust passage 300 leading from each combustion chamber through the cylinder block 180. An exhaust manifold 302 or pipe is connected to a side of the engine 174. As best illustrated in FIG. 6, the exhaust manifold 302 is connected to one side of the engine 174 while the intake system of the engine 174 is connected to the opposite side of the engine 174.

The manifold 302 has a set of branches 304 each having a passage that corresponds to one of the exhaust passages 300 leading from the combustion chambers. The branches 304 of the manifold 302 merge at a merge pipe portion 306 of the manifold 302, which extends in a generally forward direction. An exhaust pipe 308 is connected to the exhaust manifold 302 and wraps around a forward portion of the engine 174. The exhaust pipe 308 extends through the bulkhead 130 and connects with a water lock 310. A further pipe connects the water lock 310 to a muffler 312. A discharge exhaust pipe extends from the muffler to an underwater discharge 314.

The engine 174 can include a suitable lubricating system for providing lubricating oil to the various moving parts thereof and for injection with the fuel. Specifically, a lubrication reservoir 316 can be provided within the engine compartment. In some arrangements, the lubrication reservoir 316 is formed as an oil pan while in certain dry sump arrangements, the lubrication reservoir 316 may include a separate oil supply tank. Thus, the lubrication reservoir 316 can be positioned below, behind, forward of or to one side of the engine 174.

In addition, the engine 174 can include a suitable liquid and/or air cooling system. Moreover, the watercraft 20 can include a bilge system for drawing water from within the hull cavity 94 and discharging it into the body of water. For instance, in the illustrated arrangement, a mechanical bilge pump 318 that is driven by the crankshaft 186 or the impeller shaft 190 and an electrical bilge pump 320 are used. Water or other liquids picked up by either of the pumps 318, 320 is transferred through a conduit 322, 324 associated with the respective pumps 318, 320. Three outlet conduits 326, 328, 330 are provided to transfer the liquids to either a tell-tale 332 or other outlets that are disposed below the waterline. Thus, the conduits 322, 324, 326, 328, 330 extend upward and then downward to reduce the likelihood that water can back through the lines into the hull 22.

Preferably, air is drawn into the engine compartment 170 through several air ducts. As illustrated, a pair of crossing air ducts 340 are provided proximate the fuel tank 220. An upper end of each of the air ducts 340 is disposed within a respective compartment 342 defined within the side body panels 80. To reduce the likelihood that water can flow into the cavity 94 through the ducts 340, a water repellant filter 344 is disposed between the ducts 340 and the atmosphere. In the illustrated arrangement, the water repellant filter 344 is mounted over the end of each of the ducts 340. In one arrangement, the side panel or other members forming a cavity about an inlet into the ducts 340 can be sealed by a water repellant filter 344 that allows air to flow into the chamber but that substantially excludes large volumes of water from flowing into the chamber. As will be recognized, the number of ducts 340 is not critical and can be varied as desired depending upon the application. In addition, for semantics, the outer end of any air duct that extends through the hull 22 away from the hull cavity 94 is considered the inlet end while the other end of the duct that is positioned within the hull cavity 94 is considered the outlet end; however, as used herein, inlet and outlet are used for convenience and, depending upon the particular operating conditions, the flow of air through the air ducts can be in either direction or in both directions.

Of course, the foregoing description is that of certain features, aspects and advantages of the present invention to which various changes and modifications may be made without departing from the spirit and scope of the present invention. A watercraft need not feature all objects of the present invention to use certain features, aspects and advantages of the present invention. The present invention, therefore, should only be defined by the appended claims.

What is claimed is:

1. A personal watercraft comprising a deck, said deck comprising a pedestal, a seat being supported by said pedestal, a cavity being defined at least partially within said pedestal, an access opening being defined by a portion of said pedestal and said seat being disposed generally over said access opening, a control mast extending upward through said deck, said control mast being disposed forward of said seat, a storage bin being disposed between said control mast and said seat, said storage bin being at least partially disposed within a vertical volume defined by an outer periphery of said access opening, said storage bin being intersected by a longitudinally extending vertical reference plane.

2. The watercraft of claim 1, wherein said storage bin is secured to said deck by two sets of fasteners, said two sets of fasteners being disposed on two different vertical planes such that one of said two sets is vertically higher than another of said two sets.

3. The watercraft of claim 1 further comprising a cover panel that extends to at least one side of said control mast, said cover panel being secured to said storage bin by at least one transversely extending fastener.

4. The watercraft of claim 1, wherein said storage bin expands laterally outward in a downward direction.

5. The watercraft of claim 1, wherein said storage bin comprises an upper portion and a lower portion, said upper portion having a smaller volume than said lower portion.

6. The watercraft of claim 1, wherein said storage bin comprises a channel that encircles an upper end of said storage bin.

7. The watercraft of claim 6, wherein said channel is integrally-formed with said storage bin.

8. The watercraft of claim 1, wherein said storage bin comprises a lid that extends over an upper opening defined in said storage bin.

9. The watercraft of claim 1, wherein said storage bin has an upper portion and a lower portion, said lower portion extending forward of said upper portion.

10. The watercraft of claim 9, wherein said lower portion has a larger volume than said upper portion.

11. The watercraft of claim 1, wherein said seat comprises a forwardly extending mounting structure and said storage bin has a channel defined in a lower portion of said storage bin, said mounting structure being accommodated by said channel.

12. A watercraft comprising a deck and a lower hull, a longitudinal vertical plane generally bisecting said watercraft into two substantially equal portions, a cavity defined between said deck and said hull, a first storage bin being positioned along said deck such that said plane intersects said first storage bin, a second storage bin being positioned along said deck such that said plane intersects said second storage bin and a third storage bin being positioned along said deck such that said plane intersects said third storage bin, said second storage bin being disposed between said first storage bin and said third storage bin, a seat mounted generally rearward of said second storage bin and said second storage bin being accessible by an operator seated on said seat.

13. The watercraft of claim 12, wherein said second storage bin comprises a lid.

14. The watercraft of claim 13, wherein said lid is hinged to a forward side of said storage bin.

15. The watercraft of claim 12, wherein a cup holder is adapted to be mounted in said second storage bin.

16. The watercraft of claim 15, wherein an average size can that is secured in said cup holder has a bottom that rests on a portion of said container when said cup holder is mounted in said second storage bin.

17. The watercraft of claim 12, wherein said second storage bin comprises an upper portion that inclines in a rearward direction.

18. The watercraft of claim 17, wherein said second storage bin also comprises a lower portion that extends forward of said upper portion.

19. The watercraft of claim 17, wherein said second storage bin also comprises a lower portion that extends laterally outward relative to said upper portion.

20. The watercraft of claim 19, wherein said lower portion is removably secured to said deck.

21. The watercraft of claim 20, wherein said upper portion is removably secured to a central cover member.

22. The watercraft of claim 21, wherein at least one side cover is secured to said upper portion and to said deck.

23. The watercraft of claim 8, wherein said lid is adapted to open and close without removing the seat.

* * * * *